United States Patent [19]

Higashi et al.

[11] 4,361,638

[45] Nov. 30, 1982

[54] ELECTROPHOTOGRAPHIC ELEMENT WITH ALPHA -SI AND C MATERIAL DOPED WITH H AND F AND PROCESS FOR PRODUCING THE SAME

[75] Inventors: Akio Higashi; Kazuhiro Kawashiri; Yuzo Mizobuchi, all of Asaka, Japan

[73] Assignee: Fuji Photo Film Co., Ltd., Kanagawa, Japan

[21] Appl. No.: 202,201

[22] Filed: Oct. 30, 1980

[30] Foreign Application Priority Data

Oct. 30, 1979 [JP] Japan ..... 54-140284
Nov. 1, 1979 [JP] Japan ..... 54-141624

[51] Int. Cl.[3] ..... G03G 5/082; G03G 5/14

[52] U.S. Cl. ..... 430/58; 430/66; 430/84; 430/95; 252/501.1; 427/39; 427/74

[58] Field of Search ..... 430/84, 95, 58, 66; 252/501.1; 427/74, 39

[56] References Cited

U.S. PATENT DOCUMENTS

| | | | |
|---|---|---|---|
| 3,953,207 | 4/1976 | Horgan | 430/58 |
| 4,217,374 | 8/1980 | Dvshinsky et al. | 427/74 X |
| 4,225,222 | 9/1980 | Kempter | 430/57 X |
| 4,289,822 | 9/1981 | Shimada et al. | 427/74 X |

*Primary Examiner*—Roland E. Martin, Jr.
*Attorney, Agent, or Firm*—Sughrue, Mion, Zinn, Macpeak & Seas

[57] ABSTRACT

An electrophotographic light-sensitive element and process for the production thereof are described, wherein the element comprises an electrically conductive support coated with a photoconductive layer composed of a silicon- and carbon-based amorphous material doped with hydrogen and fluorine.

18 Claims, 7 Drawing Figures

ELECTROPHOTOGRAPHIC ELEMENT WITH ALPHA -SI AND C MATERIAL DOPED WITH H AND F AND PROCESS FOR PRODUCING THE SAME

BACKGROUND OF THE INVENTION

This invention relates to an electrophotographic light-sensitive element and a process for the production thereof. More particularly, the invention relates to an electrophotographic light-sensitive element having a photoconductive layer composed of a carbon- and silicon-based amorphous material, and a process for producing such an element.

Electrophotographic light-sensitive elements comprising amorphous Se alone, or amorphous Se doped with an impurity such as As, Te, Sb or Bi, as well as an electrophotographic light-sensitive element comprising CdS, are known. Such light-sensitive elements have several problems. For instance, they are very toxic, and an element comprising amorphous Se is very low in heat stability because amorphous Se crystallizes at temperatures of about 100° C. or more. Furthermore, the light-sensitive film has low mechanical strength and low resistance to hydraulic shock.

Recently, techniques have been proposed to overcome these problems of such conventional electrophotographic light-sensitive elements by using a photoconductive layer composed of amorphous silicon. Amorphous silicon prepared by hydrogen-free vapor deposition or sputtering is not desirable for use in an electrophotographic light-sensitive element, because its dark specific resistance is as low as $10^5$ ohm.cm, and its photoconductivity is also very low. This is believed to be due to many defects in the structure, caused by many broken Si-Si bonds; the hopping conduction of thermally excited carriers owing to the high average density of localized states ($10^{20}/cm^3$) within an energy gap between the conduction and filled bands of the silicon is the cause of low dark specific resistance and the capture of light-excited carriers is the cause of poor photoconductivity.

It is reported in Advances in Physics, Vol. 26, No. 6, p. 312 ff., 1977, that a non-doped amorphous silicon prepared by the glow discharge decomposition of silane ($SiH_4$) gas has a dark specific resistance of $10^9$ to $10^{10}$ ohm.cm. "Solid State Communications," Vol. 20, p. 969 ff., 1976 reports that an amorphous silicon prepared by reacting silicon with hydrogen by means of high-frequency sputtering has a dark specific resistance of $10^9$ ohm.cm. As reported therein, hydrogen compensates for the defects in the silicon crystal structure, and reduces the average density of localized states within an energy gap between the conduction and filled bands of the silicon to as low as $10^{17}$ to $10^{18}/cm^3$. The thus-produced silicon has very good photoconductivity, and valence electron control for providing a p- or n-type semiconductor is possible. However, to provide an electrophotographic light-sensitive element having an invariably high dark specific resistance is difficult without controlling the formation conditions very strictly.

Another amorphous silicon carbide produced by glow discharge decomposition is reported in *Philosophical Magazine,* Vol. 35, p. 1 ff., 1977, and an amorphous silicon carbide produced by high-frequency sputtering is reported in *Thin Solid Films,* Vol. 2, p. 79 ff., 1968. The carbide described in the first report has a dark specific resistance at room temperature of at least $10^{12}$ ohm.cm, and the one described in the second report has a dark specific resistance at room temperature of $10^8$ ohm.cm. However, few studies have been made on the photoconductivity of the amorphous silicon carbide.

SUMMARY OF THE INVENTION

Therefore, one object of this invention is to provide a novel electrophotographic light-sensitive element and a process for producing the same.

Another object of this invention is to provide an electrophotographic light-sensitive element which has high dark resistance, is thermally and chemically stable, and which has high photoconductivity, as well as a process for producing such an element.

A further object of this invention is to provide an electrophotographic light-sensitive element having a photoconductive layer composed of a carbon- and silicon-based amorphous material capable of providing good electrophotographic characteristics.

As a result of extensive studies to produce good electrophotographic characteristics using an amorphous material, we have found that the photoconductive layer composed of a carbon- and silicon-based amorphous material formed by reacting a silane or silane derivative with a carbon- and fluorine-containing gas can achieve the desired object. The amorphous material thus-formed has a very high dark specific resistance, and, surprisingly enough, has the high photoconductivity desired for use in an electrophotographic light-sensitive element.

The reason which such amorphous material has desired electrophotographic characteristics has not yet been elucidated, but since the optical band gap of the material differs greatly from that of the amorphous silicon obtained by glow-discharging a silane or silane derivative under similar conditions, it is believed that part of the amorphous silicon structure is partially replaced by carbon to form a semiconducting silicon-carbide bond structure, and that the addition of both hydrogen and fluorine contributes to further compensation of the defect in the amorphous material.

We have also found that a photoconductive material, comprising an electrically conductive support having thereon a first photoconductive layer which is doped with an impurity to provide either n-type or p-type conduction, and a second photoconductive layer having a dark specific resistance of at least $10^{10}$ ohm.cm disposed on the first photoconductive layer, has a very high dark specific resistance and photoconductivity. Although the reason for such phenomenon is also not clear, it appears that the doped layer may function as a kind of barrier against charges to be injected into the second photoconductive layer from the support side.

These objects of the invention can be achieved by an electrophotographic light-sensitive element comprising an electrically conductive support coated with a photoconductive layer composed of a silicon- and carbon-based amorphous material doped with hydrogen and fluorine. The objects of the invention are also achieved by an electrophotographic light-sensitive element wherein a photoconductive layer comprises a first layer doped with an impurity to provide either n-type or p-type conduction, and a second layer formed on said doped first layer which has a dark specific resistance of at least $10^{10}$ ohm.cm. The objects of this invention can also be accomplished by a process for producing an electrophotographic light-sensitive element wherein a photoconductive layer composed of a carbon- and silicon-based amorphous material is formed by reacting a silane or silane derivative with a carbon- and fluorine-containing gas by means of glow discharge decomposition in which a predetermined gas containing at least a gaseous silane or silane derivative and a carbon- and fluorine-containing gas is introduced into a vacuum chamber to cause a discharge of energy, which is used to decompose the gas.

BRIEF DESCRIPTION OF THE DRAWINGS

In FIGS. 2 to 6, 200, 300, 400, 500 and 600 represent electrophotographic light-sensitive elements; 201, 301, 401, 501 and 601 represent electrically conductive supports; 202, 302, 402, 502 and 602 represent supports; 203, 303, 403, 503 and 603 represent electrically conductive layers; 204, 304, 404, 504 and 604 represent photoconductive layers; 305 and 405 represent charge blocking layers; 505 and 605 represent doped first layers; 406 represents an anti-reflection layer, surface protective layer or charge transfer layer; 506 and 606 represent second layers; 207 and 507 represent surfaces of the photoconductive layers; and 607 represents a doped third layer.

DETAILED DESCRIPTION OF THE INVENTION

The electrophotographic light-sensitive element of this invention can comprise an electrically conductive support which is directly coated with a photoconductive layer that generates charge carriers upon light irradiation. Alternatively, a charge transport layer or a charge blocking layer that forms a barrier against charge carriers may be disposed between said support and photoconductive layer, and/or on the photoconductive layer. In another embodiment, the charge transport layer may be combined with the charge blocking layer.

The electrically conductive support used in this invention is selected from a sheet or film of an insulating material such as glass, ceramic or synthetic resin which is coated with a uniform deposit of an electrical conductive material (e.g., a metal such as nickel or aluminum, an alloy such as stainless steel-nichrome, or an inorganic compound such as tin oxide) and a sheet, film or foil made solely of an electrical conductive material. The support may be in the form of a plate, belt, cylinder or any other form that is determined by the ultimate intended use. An endless belt or cylinder is preferred for continuous fast copying.

According to this invention, the photoconductive layer composed of a carbon- and silicon-based amorphous material is formed on the support by glow discharge decomposition. Depending on the desired electrophotographic characteristics and other factors, glow discharge decomposition may be combined with sputtering or ion implantation.

To provide a dark specific resistance that meets the level required for photoconductive layers of electrophotographic light-sensitive element, the proportion of carbon to silicon as well as the addition of hydrogen and fluorine are controlled in the manufacture of the photoconductive layer of this invention composed of a carbon- and silicon-based amorphous material. In glow discharge decomposition, a gaseous silane or silane derivative such as $SiH_4$, $Si_2H_6$, $SiCl_4$, $SiHCl_3$, $SiH_2Cl_2$ or $Si(CH_3)_4$ which is optionally diluted with an inert gas such as $H_2$, He, Ar or Ne and at least one fluorine-containing organic gas such as $C_2H_3F$, $CH_3F$, $CF_4$, $C_2H_2F_2$, $C_2ClF_3$, $C_3F_8$, $CCl_2F_2$ or $CCl_3F$ are subjected to glow discharging, whereupon the gases are decomposed and react each other to form a photoconductive film. In sputtering, a monocrystalline or polycrystalline target having a desired proportion of carbon to silicon or a target composed of only silicon or carbon is subjected to ion bombardment of, say, Ar generated by high-frequency or D.C. glow discharge, and the so treated target composition is reacted with the above listed organic gas, fluorine-containing gas and $H_2$ gas to form a photoconductive film. The photoconductive layer of this invention can also be produced by the known ion implantation method according to which an amorphous silicon or silicon carbide film is injected with ions of silicon, carbon, hydrogen and fluorine.

Figure 7:
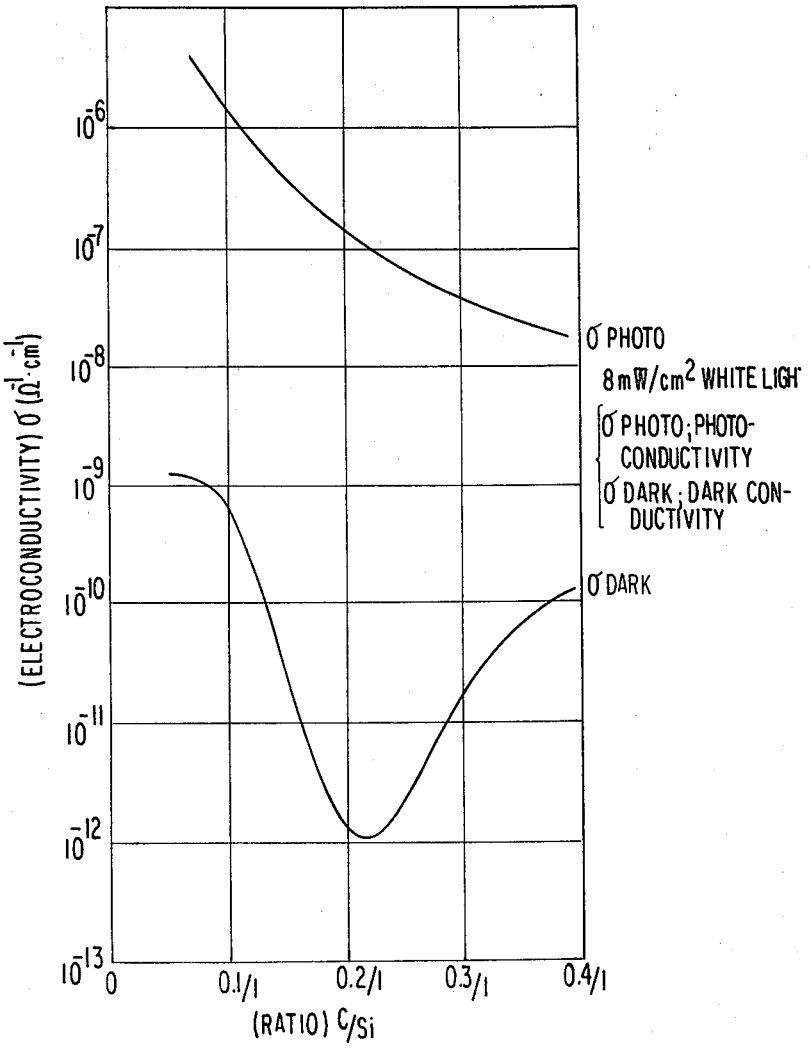
FIG. 7 is a graph showing the relation between the C/Si ratio and dark and photoconductivities ($\sigma$) of a film composed of such an amorphous material.

We have found that for the purpose of providing a photoconductive layer having high dark specific resistance and good photoconductivity and electrophotographic light-sensitive characteristics, the carbon- and silicon-based amorphous material of this invention preferably has an atomic carbon to silicon ratio (C/Si) in the range of from 0.05/1 to 0.4/1 and preferably from 0.1/1 to 0.3/1, and also contains hydrogen and fluorine. FIG. 7 shows the relation of dark conductivity and photoconductivity to C/Si of the carbon- and silicon-based amorphous material produced by glow discharge decomposition of $SiH_4$ gas and $CF_4$ gas at a substrate temperature of 220° C. As shown, a minimum dark conductivity is obtained when the C/Si ratio is about 0.21/1.

Fluorine can be incorporated in the carbon- and silicon-based amorphous material in an amount of from 0.01 to 20 atomic percent, preferably from 0.5 to 10 atomic percent, based on the total amount of atomic silicon and carbon. Hydrogen can be incorporated in an amount of from 1 to 40 atomic percent, preferably from 10 to 30 atomic percent, based on the total amount of atomic silicon and carbon. The hydrogen content can be controlled by varying the temperature of the substrate used in vacuum deposition and/or the supply of a starting material used for addition of hydrogen. Alternatively, the layer of carbon- and silicon-based amorphous material may be exposed to an activated hydrogen atmosphere. At this time, the layer of carbon- and silicon-based amorphous material may be heated at a temperature lower than the crystallizing temperature.

The carbon- and silicon-based amorphous material can be provided with desired conduction type properties by doping, so one advantage of the material is that an electrophotographic light-sensitive element using it can be charged electrically either positively or negatively for making a static image. This is a great advantage over the conventional Se-based photoconductive layer, because the latter can be rendered only p-type, or intrinsic type (i-type) at best, in spite of all possible variations in manufacturing conditions such as substrate temperature, type of impurity and its concentration and also because p-type conduction is achieved only after strict control of the substrate temperature in the latter.

To make a p-type layer of carbon- and silicon-based amorphous material, the material is doped to advantage with an element of Group IIIA of the Periodic Table, such as B, Al, Ga, In, or Tl, and to provide an n-type layer, the material is preferably doped with an element of Group VA of the Periodic Table, such as N, P, As, Sb or Bi. Since these dopants are incorporated in only a very small amount, the requirement of selecting non-polluting dopants is not as rigorous as with the main components of the photoconductive layer, but it is still preferred that the least polluting dopants be used. Dopants that meet this requirement and which provide a photoconductive layer having good electrical and optical characteristics are B, As, P and Sb.

The amount of the dopants is properly determined by the electrical and optical characteristics desired; an element of Group IIIA of the Periodic Table is generally used in an amount of from $10^{-3}$ to 5 atomic percent, preferably from $10^{-2}$ to one atomic percent, based on the total amount of atomic silicon and carbon. An element of Group VA of the Periodic Table is generally used in an amount of from $10^{-5}$ to one atomic percent, preferably from $10^{-4}$ to $10^{-1}$ atomic percent, based on the total amount of atomic silicon and carbon. But the amount of dopant varies with the substrate temperature and other operating conditions, and it is important in this invention that the resulting photoconductive layer has a dark specific resistance of at least $10^{10}$ ohm.cm.

The doping method varies depending on the method of producing the carbon- and silicon-based amorphous material. If the material is produced by glow discharge decomposition, a gas such as $B_2H_6$, $AsH_3$, $PH_3$ or $SbCl_5$ can be activated by glow discharge, and simultaneously with or after the formation of the amorphous material layer is exposed to the atmosphere of the reaction system. If the amorphous material is made by sputtering, either the method described above can be employed, or a dopant atom can be sputtered as such while the photoconductive layer is being formed. If the amorphous material is produced by ion implantation, ions of respective dopant atoms may be injected into the material.

The photoconductive layer of this invention comprises an amorphous material based on carbon and silicon, and the non-doped film exhibits n-type conduction to some extent. It is preferred that the photoconductive layer of the present invention has basically a dual-layer structure; i.e., a first layer on the support, which is doped with an impurity to provide either n- or p-type conduction, and a second layer (which may be non-doped or doped to form an intrinsic type (i-type)) disposed on the doped first layer, which has a dark specific resistance at $10^{10}$ ohm.cm or more. A possible modified structure thereof is that of a p-i-n (or n-i-p) type diode that consists of the doped first layer, the second layer having a dark specific resistance of $10^{10}$ ohm.cm or more, and a doped third layer having a conduction type opposite to that of the doped first layer.

The reason why the photoconductive layer so arranged exhibits high dark specific resistance is not completely understood, but may be as follows: When the surface of the photoconductive layer is electrically charged, charges of opposite polarity are induced on the surface of the support. Such charges recombine with the majority carrier (positive hole carrier in a p-type layer or electron carrier in an n-type layer) in the doped first layer when they are injected into the photoconductive layer. Therefore, with a photoconductive layer consisting of two layers, it is necessary to establish electric charges of a polarity on the surface of the light-sensitive element such that charges of opposite polarity are induced on the surface of the support which, when injected into the doped first layer, serves as a minority carrier (charges opposite to the majority carrier) to recombine with the majority carrier in said doped first layer. It is thus preferred that the doped first layer be adequately doped so as to capture the charges injected from the support. In a photoconductive layer consisting of three layers, the doped third layer disposed on the surface of the light-sensitive element and whose conduction type is opposite to that of the doped first layer, prevents the charges on the surface of the element from being injected into the photoconductive layer. Needless to say, the charges to be established on the surface of the light-sensitive element must be of such polarity that the same electric field is formed in the photoconductive layer as when reverse bias voltage is applied to a diode device. The non-doped layer which is of somewhat n-conduction type may be rendered intrinsic by doping a small amount of an element of Group IIIA of the Periodic Table.

Thicknesses of the doped first and third layers and the second layer having a dark specific resistance of $10^{10}$ ohm.cm or more are determined by the electrophotographic characteristics and operating conditions desired, and, generally, the doped layers have a thickness of from 0.005 to 0.3 microns, and preferably from 0.01 to 0.1 micron, and the second layer has a thickness of from 0.1 to 100 microns, and preferably from 0.3 to 50 microns.

Total thickness of the photoconductive layer of this invention is also determined by the electrophotographic characteristics and operating conditions desired. Generally, the total thickness of the photoconductive layer is from about 0.05 to about 100 microns, and preferably from 0.5 to 50 microns. When a charge transport layer is combined with the photoconductive layer, the total thickness of the photoconductive layer is generally from about 0.05 to about 2 microns.

The charge blocking layer used in this invention forms a barrier against electron and/or positive hole carriers to prevent their injection into the photosensitive layer. It is composed of insulating materials or semiconductors such as $SiO_2$, SiO, $Al_2O_3$, $ZrO_2$, $TiO_2$, $MgF_2$ and ZnS, or synthetic resins such as polycarbonate, polyvinyl butyral and polyethylene terphthalate. The blocking layer can be formed by a conventional method such as vacuum deposition, sputtering or coating. The layer is composed of an insulating material, semiconductor or organic synthetic resin having a thickness of from 0.005 to 1 micron. It may be disposed between the electrically conductive layer and photoconductive layer as well as on the surface of the photoconductive layer. An electrically conductive support that forms an electrical barrier such as a Schottky barrier between the support and the photoconductive layer may be used as the blocking layer.

The charge transport layer used in this invention is one for photo-excited carriers in a "functionally discrete" electrophotographic light-sensitive element. The layer is a good conductor for electron or positive hole carriers that has a dark specific resistance of $10^{10}$ ohm.cm or more and which has little photoconductivity for light in the visible and infrared spectra. The layer is composed of a crystalline or amorphous inorganic or organic semiconductor. For imagewise exposure from the charge transport layer side, the layer is composed of an inorganic semiconductor such as an oxide or chalcogenite semiconductor or an organic semiconductor having an optical window effect for the photoconductive layer and which provides an optical absorption edge of at least 1.5 eV. It is required with the charge transport layer on the photoconductive layer that a barrier or interface level against electron or positive hole carriers photo-excited in the photoconductive layer at the interface between the photoconductive layer and charge transport layer not be formed in order to effectively inject the carriers from the photoconductive layer into the charge transport layer and that the carriers have great motility and long life, i.e., sufficient to reach the surface of the electrophotographic light-sensitive element efficiently without being captured in the charge transport layer. The oxide semiconductors useful herein include $In_2O_3$, $TiO_2$, $SnO_2$, ZnO and PbO, the useful chalcogenite semiconductors include crystalline materials that contain CdS, ZnS and ZnCd-S, and useful amorphous materials include those that contain S, Te, and Se.

Illustrative organic semiconductors are listed below.

P-type charge transport layer forming materials:

Examples of the electron donor (which may be generically referred to as a substance in a charge transport layer) include compounds containing at least one group of an alkyl group (e.g., methyl group), alkoxy group, amino group, imino group or imido group, and compounds which have in the main chain or side chain a polycyclic aromatic compound such as anthracene, pyrene, phenanthrene or corones, or a nitrogen-containing heterocyclic compound such as indole, carbazole, oxazole, isoxazole, thiazole, imidazole, pyrazole, oxadiazole, thiadiazole or triazole. Specific examples of the low-molecular weight electron donor are hexamethylenediamine, N-(4-aminobutyl)cadaverine, asdidodecylhydrazine, p-toluidine, 4-amino-o-xylene, N,N'-diphenyl-1,2-diaminoethane, o-, m- or p-ditolylamine, triphenylamine, durene, 2-bromo-3,7-dimethylnaphthalene, 2,3,5-trimethylnaphthalene, N'-(3-bromophenyl)-N-(β-naphthyl)urea, N'-methyl-N-(α-naphthyl)urea, N,N'-diethyl-N-(α-naphthyl)urea, 2,6-dimethylanthracene, anthracene-2-phenylanthracene, 9,10-diphenylanthracene, 9,9'-bianthranyl, 2-dimethylaminoanthracene, phenanthrene, 9-aminophenanthrene, 3,6-dimethylphenanthrene, 5,7-dibromo-2-phenylindole, 2,3-dimethylindoline, 3-indolylmethylamine, carbazole, 2-methylcarbazole, N-ethylcarbazole, 9-phenylcarbazole, 1,1'-dicarbazole, 3-(p-methoxyphenyl)oxazolidine, 3,4,5-trimethylisoxazole, 2-anilino-4,5-diphenylthiazole, 2,4,5-trinitrophenylimidazole, 4-amino-3,5-dimethyl-1-phenylpyrazole, 2,5-diphenyl-1,3,4-oxadiazole, 1,3,5-triphenyl-1,2,4-triazole, 1-amino-5-phenyltetrazole, bis-diaminophenyl-1,3,6-oxadiazole, pyrazoline derivatives. Examples of the high-molecular weight electron donor are poly-N-vinylcarbazole and their derivatives (e.g., the carbazole skeleton having a substituent such as a halogen like chlorine or bromine, methyl or amino group), polyvinyl pyrene, polyvinyl anthracene, pyrene-formaldehyde polycondensate and their derivatives (e.g., the pyrene skeleton having a substituent such as a halogen like bromine, or nitro group). The compounds above are listed for illustrative purposes only and this invention is by no means limited thereto. Specific examples of the pyrazoline derivative are 1-phenyl-3-p-dimethylaminostyryl-5-10-dimethylaminophenylpyrazoline, 1-phenyl-3-p-methoxystyryl-5-p-methoxyphenylpyrazoline, 3-styryl-5-phenyl-pyrazoline, and 1,3,5-triphenylpyrazoline.

n-tupe charge transport layer forming material:

Examples of the electron acceptor (which may be generically referred to as a substance in a charge transport layer) include carboxylic acid anhydrides, compounds having an electron accepting skeleton such as an ortho- or para-quinoid structure, aliphatic, alicyclic, aromatic, and heterocyclic compounds having an electron accepting substituent such as a nitro, nitroso or cyano group. Specific examples are maleic anhydride, phthalic anhydride, tetrachlorophthalic anhydride, tetrabromophthalic anhydride, naphthalic anhydride, pyromellitic anhydride, chloro-p-benzoquinone, 2,5-dichlorobenzoquinone, 2,6-dichlorobenzoquinone, 5,8-dichloronaphthoquinone, o-chloroanil, o-bromoanil, p-chloroanil, p-bromoanil, p-iodoanil, tetracyanoquinodimethane, 5,6-quinolinedione, cumalin-2,3-dione, oxyindirubin, oxyindigo, 1,2-dinitroethane, 2,2-dinitropropane, 2-nitro-2-nitrosopropane, iminodiacetonitrile, succinonitrile, tetracyanoethylene, 1,1,3,3-tetracyanopropenide, 2,2-dicyanomethylene-1,1,3,3-tetracyanopropenide, o-, m- or p-dinitrobenzene, 1,2,3-trinitrobenzene, 1,2,4-trinitrobenzene, 1,3,5-trinitrobenzene, dinitrodibenzyl, 2,4-dinitroacetophenone, 2,4-dinitrotoluene, 1,3,5-trinitrobenzophenone, 1,2,3-trinitroanisole, α,β-dinitronaphthalene, 1,4,5,8-tetranitronaphthalene, 3,4,5-trinitro-1,2-dimethylbenzene, 3-nitroso-2-nitrotoluene, 2-nitroso-3,5-dinitrotoluene, o-, m- or p-nitronitrosobenzene, phthalonitrile, terephthalonitrile, isophthalonitrile, cyanated benzolyl, cyanated bromobenzyl, cyanated quinoline, cyanated, o-xylylene, o-, m- or p-cyanated nitrobenzyl, 3,5-dinitropyridine, 3-nitro-2-pyridone, 3,4-dicyanopyridine, α-, β- or γ-cyanopyridine, 4,6-dinitroquinone, 4-nitroxanthone, 9,10-dinitroanthracene, 1-nitroanthracene, 2-nitrophenanthrenequinone, 2,5-dinitrofluorenone, 2,6-dinitrofluorenone, 3,6-dinitrofluorenone, 2,7-dinitrofluorenone, 2,4,7-trinitrofluorenone, 2,4,5,7-tetranitrofluorenone, 3,6-dinitrofluorenonemandelonitrile, 3-nitrofluorenonemandelonitrile and tetracyanopylene.

The inorganic semiconductor or organic semiconductor forming the charge transport layer can be prepared by a conventional method of vacuum deposition, sputtering, glow discharge decomposition, coating, or spraying. The charge transport layer formed is desirably heated to a temperature between 50° and 400° C. to provide good electrical bond at the interface between the photoconductive layer and the charge transport layer. The charge transport layer used in this invention has a thickness between 0.5 to 50 microns, preferably between 0.5 to 10 microns.

A surface protective layer of anti-reflection layer may further be provided on the electrophotographic light-sensitive element of this invention to prevent large light loss that occurs when most of the light coming from the exposure source is reflected from the surface of the photoconductive layer and only a small amount of light is absorbed by the photoconductive layer. The surface protective layer or anti-reflection layer is also an electric insulator that does not cause any adverse effect on the characteristics required for the electrophotographic light-sensitive element. The layer may serve as the charge blocking layer or charge transport layer described above. The surface protective layer or anti-reflection layer may have a thickness of $\lambda/4\sqrt{n}$ (wherein n is the refractive index of the photoconductive layer, and $\lambda$ is the wavelength of the light used in exposure) or $\lambda/4\sqrt{n}$ multiplied by an odd number, and the thickness is in the range of from 0.05 to 50 microns. The surface protective layer or anti-reflection layer is formed of the same material as used in making the charge blocking layer or charge transfer layer, and vacuum deposition, sputtering, coating or any other suitable means may be employed.

Figure 1:
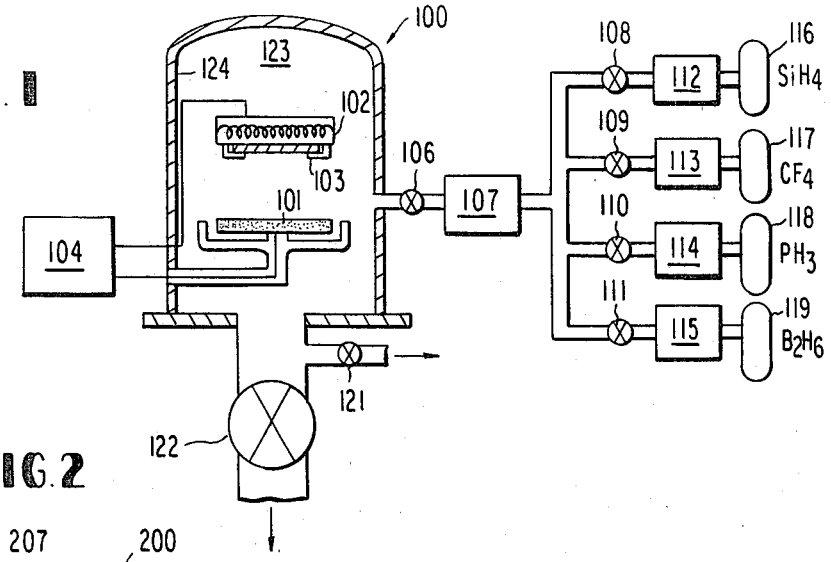
FIG. 1 is a schematic diagram of a glow discharge decomposing machine used for producing the electrophotographic light-sensitive element of this invention.

The electrophotographic light-sensitive element of this invention is hereunder described by reference to FIG. 1 which is a schematic diagram of a capacity-coupled glow discharge decomposition apparatus that can be used in making an element according to the invention. In FIG. 1, the glow discharge decomposition apparatus is generally indicated by 100, and it comprises a vacuum vessel 123 which contains a glow discharge electrode 101, a substrate supporting and heating member 102 placed a given distance above the electrode in a face-to-face relationship, and a substrate 103 that is fixed to the substrate supporting/heating member 102 and on which the photoconductive layer is formed. The glow discharge electrode 101 is electrically connected to a high-frequency generator 104 so that upon application of high-frequency power, a glow discharge is established mainly between the electrode 101 and the substrate 103.

The vacuum vessel 123 is connected to gas supply pipes through which predetermined gases from respective gas containers 116, 117, 118 and 119 are supplied with their flow controlled by needle valves 108, 109, 110 and 111 and flow meters 112, 113, 114 and 115. A filter 107 and needle valve 106 are installed midway in the gas supply system to remove solid particles from the gases being supplied. The bottom of the vacuum vessel 123 is connected to a diffusing pump and a rotary pump through a diffusing pump valve 122 and a rotary pump valve 121, respectively.

To produce a photoconductive layer composed of a carbon- and silicon-based amorphous material on the substrate 103 using the glow discharge decomposing machine of FIG. 1, the substrate is first subjected to physical or chemical washing before it is fixed to the supporting and heating member 102. A diffusing pump is used to evacuate the vacuum vessel 123 until its back pressure is less than $1\times10^{-5}$ torr. Then, with the temperature of the substrate kept at the predetermined level by the heating member 102, the diffusion pump valve 122 is closed and the rotary pump valve 121 opened to continue the evacuation of the vessel 123 with a rotary pump. While evacuation is going on, predetermined gases are supplied from their respective containers 116, 117, 118 and 119 with their flow controlled and monitored by the needle valves 106, 108, 109, 110 and 111 and flow meters 112, 113, 114 and 115. The containers 116 and 117 are filled with gases that form the amorphous photoconductive layer based on carbon and silicon, and they are gaseous silane or silane derivatives of the type described herein (which are optionally diluted with inert gases) and fluorine-containing organic gases of the type described herein, and these gases may be used in admixture. The containers 118 and 119 are filled with doping gases such as $PH_3$ and $B_2H_6$. The carbon to silicon ratio and the dopant concentration in the amorphous photoconductive layer based on carbon and silicon is freely variable by controlling the flow of the gases being supplied from the four containers, and the two factors can also be changed to vary in the direction of film thickness. The discharging of the gas supply pipe is disposed in the vacuum vessel so as to provide adequate supply of the gases in the space between the substrate 103 and the glow discharge electrode 101. If necessary, the discharging end may be disposed in a ring form that surrounds the glow discharge electrode 101 to form a gas current.

Then, the rotary pump valve 121 is adjusted to keep the back pressure of the vacuum vessel 123 between $10^{-2}$ torr and 10 torr, and a high-frequency voltage from the high-frequency generator 104 is applied to the glow discharge electrode 101 to cause a glow discharge. The frequency of the voltage applied to the electrode 101 is preferably in the range of from 0.1 to 50 MHz. A D.C. voltage of 0.3 to 5 kilovolts may be applied to the glow discharge electrode 101. The substrate supporting and heating member 102 may be grounded to the earth, or to prevent secondary electron collision due to glow discharge, it may be negatively biased at $\ominus$50 to $\ominus$500 volts. The foregoing description has assumed that the glow discharge decomposing machine 100, is of capacity-coupled type, but an induction-coupled glow discharge decomposing machine may be used wherein a coil of glow discharge electrode is disposed to surround the supporting member 102 or the wall 124 of the vacuum vessel 123.

An apparatus of the same type as illustrated in FIG. 1 can generally be used to form the carbon- and silicon-based amorphous photoconductive layer by sputtering, and high-frequency or DC sputtering is performed on a target of a desired composition placed on the glow discharge electrode of FIG. 1. The same doping method as used in the glow discharge decomposition described herein may also be used in supplying doping gases.

According to this invention, the substrate 103 being subjected to glow discharge decomposition is held between 50° and 350° C., and preferably between 100° and 300° C. A suitable substrate temperature can be achieved by the substrate supporting and heating member 102. The rate at which the photoconductive layer is deposited on the substrate is another factor that governs the physical properties of the photoconductive layer, and a preferred deposition rate is from 0.5 to 1000 Å/sec, but a deposition rate higher than 1000 Å/sec can be used.

Several embodiments of an electrophotographic light-sensitive element using the photoconductive layer composed of carbon- and silicon-based amorphous according to this invention are shown in FIGS. 2 to 6.

Figure 2:
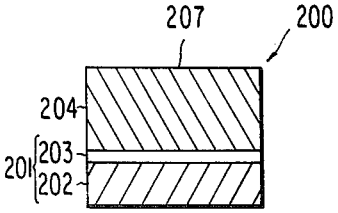
FIG. 2 is a cross section of the electrophotographic light-sensitive element according to one embodiment of this invention.

FIG. 2 shows an electrophotographic light-sensitive element which is generally indicated by 200, and an electrically conductive support 201 that consists of a support 202 and an electrically conductive layer 203; the layer 203 can be omitted if the support 202 is electrically conductive. A photoconductive layer 204 composed of the carbon- and silicon-based amorphous material formed according to the method of this invention is disposed on the electrically conductive support 201, and the layer consists of a non-doped layer and/or a doped layer. The surface 207 of the photoconductive layer 204 is charged either positive or negative with respect to the support 201, and a positive or negative charged latent image formed by imagewise exposure is subjected to liquid development, cascade development or magnetic brush development, and the developed image is transferred to a transfer paper to obtain a permanent copy.

Figure 3:
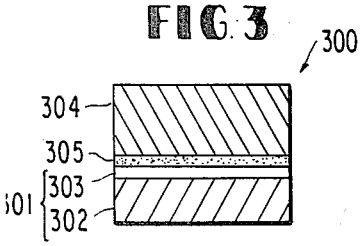
FIGS. 3 to 6 are cross sections of electrophotographic light-sensitive elements according to other embodiments of this invention.

FIG. 3 shows another embodiment of the electrophotographic light-sensitive element of this invention wherein a charge blocking layer 305 is disposed on an electrically conductive support 301. The charge blocking layer 305 may be disposed between the conductive support 301 and a photoconductive layer 304, and/or on the photoconductive layer 304.

Figure 4:
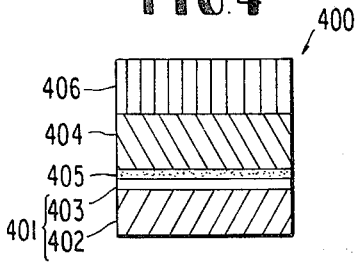

In the embodiment shown in FIG. 4, a layer 406 that serves as an anti-reflection layer, surface protective layer or charge transport layer is disposed on a photoconductive layer 404, and if the layer 406 is a charge transport layer, it may be disposed between the photoconductive layer 404 and a charge blocking layer 405.

Figure 5:
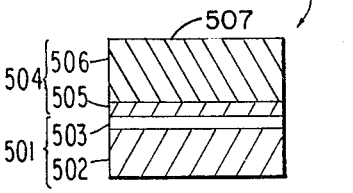

FIG. 5 shows an electrophotographic light-sensitive element 500 which is generally indicated at 500, and an electrically conductive support 501 that consists of a support 502 and an electrically conductive layer 503, and the layer 503 can be omitted if the support 502 is electrically conductive. A photoconductive layer 504 composed of the carbon- and silicon-based amorphous material formed according to the method of this invention is disposed on the electrically conductive support 501, and the layer consists of a non-doped layer or a substantially intrinsic doped layer 506 and a doped layer 505 having either n- or p-type conduction. The surface 507 of the photoconductive layer 504 is charged either positively or negatively with respect to the support 501, and a positive or negative charge latent image formed by imagewise exposure is subjected to liquid development, cascade development or magnetic brush development, and the developed image is transferred to a transfer paper to obtain a permanent copy.

Figure 6:
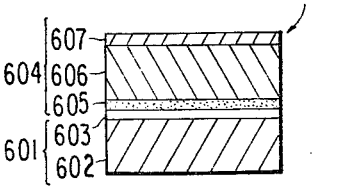

FIG. 6 shows another embodiment of the electrophotographic light-sensitive element of this invention wherein a photoconductive layer 604 is disposed on an electrically conductive support 601, and the photoconductive layer 604 consists of a doped first layer 605 having either n- or p-type conduction, a non-doped or intrinsic doped second layer 606, and a doped third layer 607 having a conduction type opposite to that of the first doped layer.

As described herein, this invention provides nontoxic electrophotographic elements that adequately satisfy the conditions required for such electrophotographic light-sensitive element. The light-sensitive element produced by the method of this invention can also be used as a light-receiving device or a photoelectric converter device such as a solar cell.

This invention is now described in greater detail by reference to the following examples which are given here for illustrative purposes only, and are not intended to limit the scope of the invention.

EXAMPLE 1

A slide glass in a capacity-coupled glow discharge decomposition apparatus of the type shown in FIG. 1 was coated with a Ni electric conducting layer 0.1 micron thick by high-frequency sputtering, and a photoconductive layer was disposed on the resulting electric conducting support to produce an electrophotographic light-sensitive element as shown in FIG. 2. The photoconductive layer was composed of a carbon- and silicon-based amorphous material that was formed by supplying $SiH_4$, Ar and $CF_4$ gases under the following conditions.

(Gases supplied)

$SiH_4$ (diluted with Ar; 10.7% of $SiH_4$) supplied at 140 cc/min $CF_4$ supplied at a $CF_4/SiH_4$ partial pressure ratio of 1.1:1.0

(Other conditions)

Back pressure of vacuum vessel: $6\times10^{-6}$ torr

Frequency and power: 13.56 MHz, 70 W (0.29 $W/m^2$)

Substrate temperature: 220° C.

Deposition rate: 300 Å/min

Degree of vacuum during discharge: 0.4 torr

Cathode-to-substrate distance: 2.3 cm

A coating of photoconductive layer 1.8 microns thick was deposited on the substrate under the conditions specified above. ESCA analysis showed that the carbon-to-silicon ratio of the photoconductive layer was 0.21/1. The surface of the resulting light-sensitive sheet was electrified by a corona discharge (⊕8 kilovolts), and the attenuation of the surface potential upon exposure to a halogen lamp (1.71 and 0.15 lux) was measured. The results are shown in Table 1.

TABLE 1

| Light intensity (lux) | ⊕ Vo (V) | $\dot{\epsilon}/I$ | $E_{\frac{1}{2}}$ (lux · sec) |
|---|---|---|---|
| 0.15 | 35 | 15.0 | 0.6 |
| 1.7 | 35 | 4.0 | 1.5 |

wherein

Vo; surface potential before exposure (Volt)

$\dot{\epsilon}/I$; initial surface potential attenuation rate (volt/μ · sec · lux) and $E_{\frac{1}{2}}$; exposure required for surface potential to be decreased to half.

The light-sensitive sheet was subjected to an imagewise exposure of 2 lux.sec to form a static latent image which was developed by liquid development with a negative toner, and the developed image was transferred to a transfer paper and fixed. A sharp unfogged image of high density was obtained.

EXAMPLE 2

An electric conducting substrate identical to that described in Example 1 was coated with a photoconductive layer to form an electrophotographic light-sensitive element as shown in FIG. 3. A charge blocking layer was formed as follows: a high-frequency sputtering apparatus (Model 4400 of Perking-Elmer Co.) was supplied with argon and oxygen in $Ar/O_2$ partial pressure ratio of 10:1, and with the back pressure of the vacuum chamber held at $5\times10^{-3}$ torr, electric power was applied to a silicon target (freq.: 13.56 MHz, hf power density: 3.2 $W/cm^2$), and the silicon was reacted with oxygen at a substrate temperature of 250° C. to form a $SiO_2$ layer 0.05 microns thick. A photoconductive layer composed of carbon- and silicon-based amorphous material was prepared by supplying Ar-diluted $SiH_4$ gas and $CF_4$ gas under the following conditions.

(Gases supplied)

$SiH_4$ (diluted with Ar; 10.7% of $SiH_4$) supplied at 140 cc/min $CF_4$ supplied at $CF_4/SiH_4$ partial pressure ratio of 0.8:1.0

(Other conditions)

Back pressure of vaccum vessel: $8\times10^{-6}$ torr

Frequency and power: 13.56 MHz, 70 W (0.29 $W/m^2$)

Substrate temperature: 170° C.

Deposition rate: 200 Å/min

Degree of vacuum during discharge: 0.4 torr
Cathode-to-substrate distance: 2.3 cm A coating of photoconductive layer 1.2 microns thick was deposited on the substrate under the conditions specified above. The surface of the resulting light-sensitive sheet was electrified by a corona discharge (⊕8 kilovolts or ⊖8 kilovolts), and the attenuation of the surface potential upon exposure to light was measured. The results are indicated in Table 2.

TABLE 2

| Light Intensity (lux) | ⊕ Vo (V) | ⊕ $\dot{\epsilon}$/I (Volt/sec lux) | ⊖ Vo (V) | ⊖ $\dot{\epsilon}$/I (Volt/sec lux) |
|---|---|---|---|---|
| 0.15 | 35 | 8.5 | 40 | 14 |
| 1.7 | 35 | 1.6 | 40 | 3.0 |

The light-sensitive sheet was positively charged, subjected to an imagewise exposure of 3 lux·sec to form a static latent image which was developed by cascade development with a positive toner, and the developed image was transferred to a transfer paper and fixed. A sharp unfogged image of high density was obtained.

EXAMPLE 3

The procedure and conditions of Example 1 were used to form an electrophotgraphic light-sensitive sheet as shown in FIG. 4 (with no charge blocking layer) which comprised a phtoconductive layer composed of carbon- and silicon-based amorphous material (1.8 microns thick) on an aluminum substrate, and a charge transport layer formed on the photoconductive layer. The charge transport layer was formed by applying a coating (5 microns thick) of a dispersion of $1.6\times10^{-3}$ mol of an electron donating organic semiconductor 1-phenyl-3-p-methoxystyryl-5-p-methoxypyrazoline in one gram of a solvent comprising 0.09 g of polycarbonate and 1 cc of dichloromethane. The resulting layer was heated in air at 130° C. for 20 minutes. The surface of the electrophotographic light-sensitive sheet thus obtained was electrified by a corona discharge (⊖8 kilovolts) and the attenuation of its surface potential upon exposure to light was measured. The results are shown in Table 3.

TABLE 3

| Light Intensity (lux) | ⊖ Vo (V) | $\dot{\epsilon}$/I (Volt/μ · sec · lux) | $E_{\frac{1}{2}}$ (lux · sec) |
|---|---|---|---|
| 0.15 | 370 | 15 | 1.7 |
| 1.7 | 360 | 4.2 | 7.1 |
| 12.5 | 360 | 2.4 | 12 |

The sheet was charged negative and subjected to an imagewise exposure of 10 lux.sec to form a static latent image which was developed by cascade development with a positive toner, and the developed image was transferred to a transfer paper and fixed. A sharp unfogged image of high density resulted.

EXAMPLE 4

The procedure and conditions of Example 1 were repeated to form a photoconductive layer composed of carbon- and silicon-based amorphous material 1.8 microns thick on an aluminum substrate, and a polycarbonate resin was applied to the photoconductive layer in a thickness of 2 microns as a surface protective and anti-reflection layer, and said resin layer was dried to form an electrophotographic light-sensitive sheet of the structure shown in FIG. 4 (with no charge blocking layer). The sheet was subjected to a corona discharge (⊕8 kV) for primary electrification and also subjected to a corona discharge at ⊖7 kV for secondary electrification. The sheet was then subjected to an imagewise exposure of 10 lux sec to form a static latent image which was developed by liquid development with a negative toner, and the developed image was transferred to a transfer paper and fixed. A sharp unfogged image of high density was obtained.

EXAMPLE 5

A photoconductive layer composed of carbon- and silicon-based amorphous material was formed on an aluminum substrate using the conditions for Example 1 except that the $CF_4/SiH_4$ partial pressure ratio was 0.8/1.0 and the deposition rate was 260 Å/min. ESCA analysis showed that the C/Si ratio of the photoconductive layer was 0.18/1.0. An electrophotographic light-sensitive element of the structure indicated in FIG. 4 (with no charge blocking layer) was prepared by forming a charge transport layer 0.4 microns thick on the photoconductive layer. The transport layer was formed by electron beam vacuum deposition wherein sintered ZnS as n-type inorganic semiconductor was evaporated by heating with electron beams. During the vacuum deposition, the substrate was not heated, and instead, after the vacuum deposition, the charge transport layer and photoconductive layer on the substrate was subjected to annealing at 200° C. for 2 hours in atmosphere. The surface of the electrophotographic light-sensitive element was electrified by a corona discharge at ⊕8 kV, and the attenuation of its surface potential upon exposure to light was measured. The results are shown in Table 4.

TABLE 4

| Light Intensity (lux) | ⊕ Vo (V) | $\dot{\epsilon}$/I (Volt/μ · sec · lux) | $E_{\frac{1}{2}}$ (lux · sec) |
|---|---|---|---|
| 0.15 | 60 | 16 | 3.0 |
| 1.7 | 65 | 12.5 | 25 |

The surface of the light-sensitive sheet was charged positive by a corona discharge at ⊕8 kV and subjected to an imagewise exposure of 6 lux·sec to form a static latent image which was developed by liquid development with a negative toner, and the developed image was transferred to a transfer paper and fixed. A sharp unfogged image of high density was obtained.

EXAMPLE 6

An electrophotographic light-sensitive element having a photoconductive layer 5 microns thick on an aluminum substrate as shown in FIG. 2 was prepared by repeating the procedure and conditions in Example 1 except that the vacuum vessel was supplied with 0.1 vol% of $B_2H_6$ gas as a p-type doping gas. The surface of the resulting light-sensitive element was electrified by a corona discharge at either ⊕ or ⊖8 kV. The attenuation of surface potential upon exposure to light was such that the element rendered p-type conduction by doping of B was negatively charged (a non-doped element was slightly negatively charged). The surface of such sensitive element was charged negative by a corona discharge at ⊖8 kV and subjected to an imagewise exposure of 50 lux.sec to form a static latent image which was developed by liquid development with a positive toner, and the developed image was transferred to a transfer paper and fixed. A sharp unfogged image of high density resulted.

EXAMPLE 7

A slide glass in a capacity-coupled glow discharge decomposing machine of the type shown in FIG. 1 was coated with a Ni electric conducting layer 0.1 micron thick by high-frequency sputtering, and a photoconductive layer was placed on the resulting electric conducting support to produce an electrophotographic light-sensitive element as shown in FIG. 5. The photoconductive layer was composed of a carbon- and silicon-based amorphous material that was formed by supplying $SiH_4$, Ar, $CF_4$ and $B_2H_6$ gases under the following conditions.

(gases supplied)

$SiH_4$ (diluted with Ar; 10.7% of $SiH_4$) supplied at 140 cc/min $CF_4$ supplied at a $CF_4/SiH_4$ partial pressure ratio of 1.1:1.0

$B_2H_6$ (diluted with Ar; 10.5% of $B_2H_6$) supplied in 2 vol%

(Other conditions)

Back pressure of vacuum vessel: $6\times10^{-6}$ torr

Frequency and power: 13.56 MHz, 70 W (0.29 $W/m^2$)

Substrate temperature: 220° C.

Deposition rate: 280 Å/min

Degree of vacuum during discharge: 0.4 torr

Cathode-to-substrate distance: 2.3 cm

By glow discharged decomposition of a mixture of $SiH_4$, $CF_4$ and $B_2H_6$ under the conditions specified above, a p-type B-doped layer 500 Å thick was deposited on the electric conducting support. ESCA analysis showed that the p-type photoconductive layer so formed had a C/Si ratio of 0.22:1.0. The photoconductive layer had a dark conductivity of $(1.5\times10^{-3})$ $ohm^{-1}.cm^{-1}$. $SiH_4$, Ar and $CF_4$ gases were further supplied to form a non-doped layer 5 microns thick on the B-doped layer. The surface of the electrophotographic light-sensitive sheet thus obtained was electrified by a corona discharge at ⊕8 kV, and the attenuation of the surface potential upon exposure to a halogen lamp (1.7 and 0.15 lux) was measured. The results are shown in Table 5.

TABLE 5

| Light Intensity (lux) | ⊕ Vo (V) | $\dot{\epsilon}/I$ | $E_{\frac{1}{2}}$ |
|---|---|---|---|
| 0.15 | 100 | 8.1 | 1.5 |
| 1.7 | 100 | 3.3 | 3.4 |

wherein

Vo: surface potential before exposure, $\dot{\epsilon}/I$: initial surface potential attenuation rate (volt/μ · sec · lux); and $E_{\frac{1}{2}}$: exposure required for surface potential to be decreased to half.

Due to inhibited electron injection from the electric conducting layer, the dark attenuation rate of the electrophotographic light-sensitive element thus prepared was half that of an electrophotographic light-sensitive element wherein the photoconductive layer was composed of only the non-doped layer. The light-sensitive element was then subjected to an imagewise exposure of 5 lux·sec to form a static latent image which was developed by liquid development with a negative toner, and the developed image was transferred to a transfer paper and fixed. A sharp unfogged image of high density resulted.

EXAMPLE 8

An electrophotographic light-sensitive element as shown in FIG. 6 was prepared by forming a photoconductive layer composed of carbon- and silicon-based amorphous material on an electric conducting substrate that was identical with what was used in Example 7. The photoconductive layer was doped with B and P from 2 vol% of $B_2H_6$ and 1 vol% of $PH_3$ supplied under the same conditions as used in Example 7. A B-doped layer was first deposited in a thickness of 450 Å, then a non-doped layer in a thickness of 5 microns, and finally a P-doped layer in a thickness of 450 Å to form a p-i-n type semiconductor. Because of the n-type conducting layer formed on the top of the photoconductive layer to inhibit the injection of positive holes into the surface, the potential of the positively charged electrophotographic light-sensitive element was 20 to 30% higher than that of the p-i type semiconductor prepared in Example 7.

The light-sensitive sheet thus-produced was charged positive and subjected to an imagewise exposure of 3 lux sec to form a static latent image, which was developed by cascade development with a positive toner, and the developed image was transferred to a transfer paper and fixed. A sharp unfogged image of high density was obtained.

EXAMPLE 9

Under the same conditions as used in Examples 7 and 8, a photoconductive layer having a n-i-p structure the reverse of that of the photoconductive layer prepared in Example 8 was formed on an electric conducting substrate (the same as what was used in Examples 7 and 8). An n-type conducting layer 430 Å thick was formed by glow discharge decomposing 1 vol% of $PH_3$ gas supplied together with a mixture of $SiH_4$, $CF_4$ and Ar gases. The n-type layer had a dark conductivity of $(1.0\times10^{-5})$ $ohm^{-1}.cm^{-1}$ and an adequately high electron carrier density. The n-type doped layer was overlaid with a non-doped layer 4 microns thick and with a p-type B-doped layer 640 Å thick that contained 8 vol% of $B_2H_6$. The surface of the electrophotographic light-sensitive element thus formed was electrified by a corona discharge at ⊖8 kV, and the attenuation of its surface potential upon exposure to a halogen lamp (1.7 and 0.15 lux) was measured. The results are shown in Table 6.

TABLE 6

| Light Intensity (lux) | ⊖ Vo (V) | $\dot{\epsilon}/I$ (Volt/μ · sec · lux) | $E_{\frac{1}{2}}$ (lux · sec) |
|---|---|---|---|
| 0.15 | 50 | 3.5 | 1.0 |
| 1.7 | 50 | 2.9 | 3.5 |

The surface of the light-sensitive sheet was charged negative by a corona discharge at ⊖8 kV, and subjected to an imagewise exposure of 10 lux·sec to form a static latent image which was developed by liquid development with a positive toner, and the developed image was transferred to a transfer paper and fixed. A sharp unfogged image of high density was obtained.

EXAMPLE 10

Under the same conditions as used in Example 7, a photoconductive layer composed of a carbon- and silicon-based amorphous material that comprised a p-type conducting layer 500 Å thick and a non-doped layer 5 microns thick formed on an aluminum substrate was prepared. The photoconductive layer was coated with a polycarbonate resin in a thickness of 2 microns in an anti-reflection layer, and the layer was dried to form an electrophotographic light-sensitive sheet as shown in FIG. 4 (with no charge blocking layer). The sheet was subjected to a corona discharge (⊕8 kV) for primary electrification and also subjected to a corona discharge at ⊖7 kV for primary electrification and also subjected to a corona discharge at ⊖7 kV for secondary electrification. The sheet was then subjected to an imagewise exposure of 10 lux·sec to form a static latent image which was developed by liquid development with a negative toner, and the developed image was transferred to a transfer paper and fixed. A sharp unfogged image of high density was obtained.

EXAMPLE 11

Under the same conditions as used in Example 7, an n-type conducting layer 400 Å thick was formed on an aluminum substrate by supplying 1.5 vol% of $PH_3$ together with $SiH_4$, Ar and $CF_4$ gases, and a non-doped layer was deposited on that layer in a thickness of 1.5 microns, thereby forming a photoconductive layer composed of carbon- and silicon-based amorphous material. On such photoconductive layer, a charge transport layer composed of an organic semiconductor was deposited to form an electrophotographic light-sensitive sheet of the type described in FIG. 4 (no charge blocking layer). The charge transport layer was formed by applying a coating (5 microns thick) of a dispersion of $1.6\times10^{-6}$ mol of an electron donating organic semiconductor 1-phenyl-3-p-methoxystyryl-5-p-methoxypyrazoline in one gram of a solvent comprising 0.09 g of polycarbonate and 1 cc of dichloromethane. The resulting layer was heated in air at 130° C. for 20 minutes. The surface of the electrophotographic light-sensitive sheet thus obtained was electrified by a corona discharge (⊕8 kV) and the attenuation of its surface potential upon exposure to light was measured. The results are shown in Table 7.

TABLE 7

| Light Intensity (lux) | ⊖ Vo (V) | $\dot{\epsilon}/I$ (Volt/μ · sec · lux) | $E_{\frac{1}{2}}$ (lux · sec) |
|---|---|---|---|
| 0.15 | 360 | 14 | 1.5 |
| 1.7 | 360 | 4.5 | 6.0 |
| 12.5 | 360 | 2.4 | 12.0 |

The surface of the sheet was charged negative by a corona discharge at ⊖8 kV and subjected to an imagewise exposure of 10 lux·sec to form a static latent image which was developed by cascade development with a positive toner, and the developed image was transferred to a transfer paper and fixed. A sharp unfogged image of high density was obtained.

While the invention has been described in detail and with reference to specific embodiment thereof, it will be apparent to one skilled in the art that various changes and modifications can be made therein without departing from the spirit and scope thereof.

What is claimed is:

1. An electrophotographic light-sensitive element comprising an electrically conductive support coated with a photoconductive layer composed of a silicon- and carbon-based amorphous material doped with hydrogen and fluorine, wherein the amorphous material has a carbon to silicon atomic ratio in the range of from about 0.1:1 to about 0.3:1 and wherein the amount of fluorine doped in said amorphous material is from 0.01 to 20 atomic %, based on the total amount of atomic silicon and carbon.

2. An electrophotographic light-sensitive elements according to claim 1 wherein the photoconductive layer comprises a first layer of said silicon- and carbon-based amorphous material doped with hydrogen and fluorine and further doped with an impurity to provide either p-type or n-type conduction on the support and a second layer of said silicon- and carbon-based amorphous material doped with hydrogen and fluorine and having a dark specific resistance of at least $10^{10}$ ohm.cm on said first layer.

3. An electrophotographic light-sensitive element according to claim 2 wherein the second layer is overlaid with a doped third layer of said silicon- and carbon-based amorphous material doped with hydrogen and fluorine which is further doped with an impurity to provide a conduction type opposite to that of the first layer.

4. An electrophotographic light-sensitive element according to claim 1, 2 or 3, wherein a charge transport layer is provided between the support and the photoconductive layer, and/or on the surface of the photoconductive layer on the side thereof opposite the support.

5. An electrophotographic light-sensitive element according to claim 4 wherein an anti-reflection layer is further provided on the surface of the element on the side thereof opposite the support.

6. An electrophotographic light-sensitive element according to claim 1, 2, or 3 wherein the amount of hydrogen doped therein is from 1 to 40 atomic percent, based on the total amount of atomic silicon and carbon.

7. An electrophotographic light-sensitive element according to claim 1, 2, or 3 wherein the amount of hydrogen doped therein is from 10 to 30 atomic percent, based on the total amount of atomic silicon and carbon.

8. An electrophotographic light-sensitive element according to claim 1, 2, or 3 wherein the amount of fluorine doped therein is from 0.5 to 10 atomic percent, based on the total amount of atomic silicon and carbon.

9. An electrophotographic light-sensitive element according to claim 7 wherein fluorine is incorporated therein in an amount from 0.5 to 10 atomic percent, based on the total amount of atomic silicon and carbon.

10. An electrophotographic light-sensitive element according to claim 2 or 3 therein said impurity is an element of Group IIIA or Group VA of the Periodic Table.

11. An electrophotographic light-sensitive element according to claim 10 wherein the impurity is an element of Group IIIA.

12. An electrophotographic light-sensitive element according to claim 10 wherein the impurity is an element of Group VA.

13. An electrophotographic light-sensitive element according to claim 2 or 3 wherein the impurity is selected from the group consisting of B, As, P and Sb.

14. An electrophotographic light-sensitive element according to claim 11 wherein the amount of the element of Group IIIA is from $10^{-3}$ to 5 atomic percent, based on the total amount of atomic silicon and carbon.

15. An electrophotographic light-sensitive element according to claim 11 wherein the amount of the element of Group IIIA is from $10^{-2}$ to 1 atomic percent based on the total amount of atomic silicon and carbon.

16. An electrophotographic light-sensitive element according to claim 12 wherein the amount of the element of Group VA is from $10^{-5}$ to 1 atomic percent based on the total amount of atomic silicon and carbon.

17. An electrophotographic light-sensitive element according to claim 12 wherein the amount of the element of Group VA is from $10^{-4}$ to $10^{-1}$ atomic percent based on the total amount of atomic silicon and carbon.

18. An electrophotographic light-sensitive element according to claim 1, wherein said layer has a dark specific resistance of at least $10^{10}$ ohm. cm.

* * * * *